US008247672B2

(12) United States Patent
James

(10) Patent No.: US 8,247,672 B2
(45) Date of Patent: Aug. 21, 2012

(54) PIANO MUFFLER SYSTEM AND METHOD OF INSTALLATION

(76) Inventor: Steven James, Salem, WI (US)

( * ) Notice: Subject to any disclaimer, the term of this patent is extended or adjusted under 35 U.S.C. 154(b) by 578 days.

(21) Appl. No.: 12/384,236

(22) Filed: Apr. 1, 2009

(65) Prior Publication Data

US 2010/0251872 A1 Oct. 7, 2010

(51) Int. Cl.
*G10C 3/18* (2006.01)

(52) U.S. Cl. ..... 84/255

(58) Field of Classification Search ..... 84/423 R, 84/2, 13, 21, 26, 33, 35, 433
See application file for complete search history.

(56) References Cited

U.S. PATENT DOCUMENTS 2,727,420 A 12/1955 Welsh
3,640,171 A 2/1972 Giglio
4,450,747 A 5/1984 Aoyama
4,633,753 A 1/1987 Takahashi
4,704,931 A 11/1987 Nagai et al.
4,970,929 A 11/1990 Ishida
6,545,205 B2 * 4/2003 Chono ..... 84/423 R

* cited by examiner

*Primary Examiner* — Kimberly Lockett
(74) *Attorney, Agent, or Firm* — Jansson Shupe & Munger Ltd.

(57) ABSTRACT

A muffler mechanism that reduces the volume of an acoustic piano without altering the feel of the piano to a human pianist. One embodiment includes a highly configurable piano muffler kit that may be mounted into pianos of various models. The muffler mechanism includes a cushioning member, which muffles the sound of the hammer striking the string and reduces the volume of the sound made by the string's vibration. The muffler mechanism also includes shims that may be used to position the cushioning member between a hammer let-off position and the string. This may allow for muffled piano playing without a noticeable change in the resistance of the keys. The muffler mechanism is mounted using brackets with a relatively small footprint. This allows the piano muffler to be installed without removing all of the dampers.

21 Claims, 4 Drawing Sheets

PIANO MUFFLER SYSTEM AND METHOD OF INSTALLATION

BACKGROUND OF THE INVENTION

1. Field of the Invention

The present invention relates to acoustic pianos, and in particular to a system for reducing the volume of an acoustic piano.

2. Background of the Technology

Acoustic pianos may be enjoyed in many different circumstances. Pianos may be used for practice, or may be played for the enjoyment of the pianist and others. In addition, pianos may be used to create pleasing background music, for example, during parties, in restaurants, or in retail stores.

In some situations, piano owners may wish for the piano to be played at a reduced volume. Reduced volume may be desirable, for example, during practice sessions, in the evenings, or when background music is desired.

In normal piano playing, when a key is depressed, a hammer strikes one or more strings, causing them to vibrate and create a tonal sound. The action of the hammer striking the strings creates a percussive sound apart from the desired tonal sound. Some piano owners find this percussive sound objectionable, and wish to reduce or eliminate the percussive sound.

In recent years, electronic reproducing pianos have become increasingly popular. Electronic reproducing pianos are conventional acoustic pianos that have been equipped with an electronic mechanism that can recreate recorded music. Electronic reproducing pianos may be played in a conventional way by a human pianist, or may play recorded music from a compact disc, electronic file, or other medium.

Many piano owners use electronic player pianos to play background music during social events, when decreased volume is often desired. However, there are many types of electronic player mechanisms with varying configurations. In addition, many electronic player mechanisms are installed as after-market additions, so there are many combinations of piano models and electronic player mechanisms. This lack of consistency makes it difficult to design compatible mechanisms.

While conventional pianos do have a soft pedal that reduces the piano volume slightly, the soft pedal is designed to create temporary reductions in volume so that the listener may enjoy contrasting dynamic effects within a performance. The soft pedal is not designed to reduce the overall volume of a performance. In order to use the soft pedal, the pianist must depress the pedal by foot. Continually depressing the soft pedal would be distracting for pianists. In addition, use of the soft pedal does not noticeably reduce the percussive sound of the hammer striking the string. Furthermore, depressing the soft pedal is inconvenient or impossible during a reproduction of recorded music.

U.S. Pat. No. 4,970,929 to Ishida discloses a muffler system for acoustic pianos. A muffler member made of a cushioning material, such as felt, may be interposed between the hammer and the string to create a low sound level performance. The muffler member may be moved to a retreated position if a regular performance is desired.

As described in Ishida, the muffler member is hard to bend due to its rigidity, and a key being pressed is heavy to the touch. Thus, a human pianist depressing a key will be able to sense the presence of the muffler member. The pianist will feel increased resistance when the hammer strikes the muffler member. This increased resistance may be distracting to pianists.

Ishida attempts to rectify this problem by providing elongated slits in the muffler member. The elongated slits decrease the rigidity of the muffler member. However, even if elongated slits are provided, a pianist will feel increased resistance, because the hammer strikes the muffler member while the pianist is in the process of depressing the key.

Furthermore, the muffler mechanism of Ishida is difficult to install or repair. The muffler mechanism in Ishida is large and cumbersome. In order to install or repair the muffler mechanism of Ishida, all of the dampers must be removed from the piano. This increases the complexity of installation and repair. Furthermore, the dampers are difficult to remove and replace, and are easily damaged. Thus, if all the dampers are removed, there is increased potential for damage.

In addition, the muffler mechanism of Ishida is not configurable. The muffler mechanism of Ishida is of a fixed length, such that it may not fit into many pianos. Furthermore, in Ishida, the position of cushioning member may not be adjusted.

SUMMARY OF THE INVENTION

Accordingly, it is an object of the present invention to provide a muffler mechanism which will reduce the volume of an acoustic piano without altering the feel of the piano to a human pianist. It is a further object of the invention to provide a muffler mechanism that is simple to install or repair. It is a further object of the invention to provide a muffler mechanism that is compatible with a number of different piano models. It is yet another object of the present invention to provide a muffler mechanism that may be installed in an electronic player piano.

One embodiment of the present invention includes a piano muffler kit that is designed to be mounted into an acoustic piano. The piano muffler kit is highly configurable so that it may fit into existing pianos of various configurations. The piano muffler kit may include one or more rail portions, which may be cut down or otherwise adapted as a front rail and a back rail, one or more wing extension portions, which may be cut down or otherwise adapted as wing extensions, and one or more rod portions, which may be cut down or otherwise adapted as one or more glide rails, and which may be fixed to the front rail and the back rail. The piano muffler kit also includes one or more brackets configured and dimensioned to be mounted to a damper guide rail, the brackets having through-holes to allow the glide rails to slide through the brackets.

The piano muffler kit may also include a cushioning member, which may be mounted to a front rail and used to muffle the sound of the piano. Shims may be placed, for example, beneath the brackets in order to mount the cushioning member between a hammer let-off position and a string. This may allow for muffled piano playing without a noticeable change in the resistance of the keys.

The brackets may also have a length that is substantially less than the length of the damper guide rail. This allows the piano muffler to be installed without removing all of the dampers. Some of the dampers may be removed to allow access to the damper guide rail. The remaining dampers may be left in place during installation.

DETAILED DESCRIPTION

Embodiments of the invention provide systems and methods for reducing the sound of an acoustic piano. Example embodiments will now be described in conjunction with the following figures.

Figure 1:
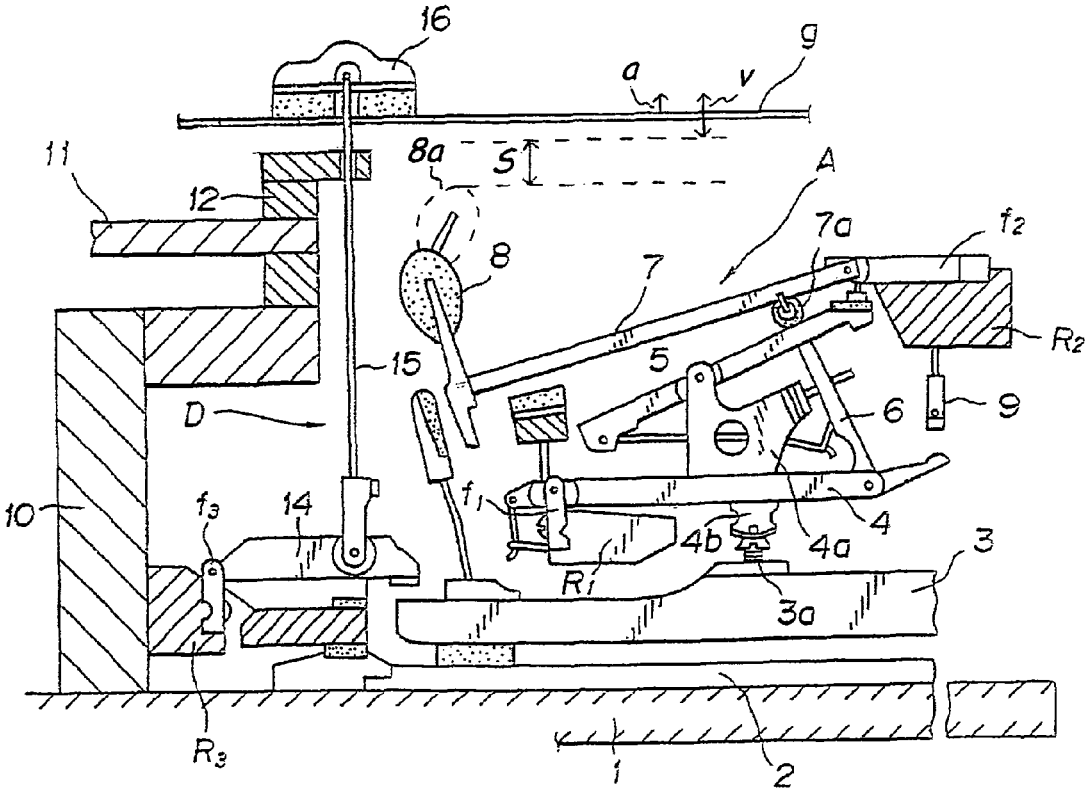
FIG. 1 is a side view of a prior art piano key action mechanism, with the piano shown in cross section, in conjunction with which embodiments of the invention may be practiced.

FIG. 1 is a side view of a prior art piano key action mechanism, with the piano shown in cross section. As shown in FIG. 1, a key bed 1 is provided in a piano, and a square frame type keyboard guide bar 2 is provided on the key bed 1. A number of keys 3 are set above the keyboard guide bar 2 so that the keys 3 can be turned via a central balance rail (not shown), and action mechanisms A are provided above the respective keys 3.

The action mechanism A consists of a wippen 4 supported pivotably at the rear end thereof on a flange $f_1$ on a center rail $R_1$, a repetition lever 5 connected pivotably at the intermediate portion thereof to a post 4*a* on the intermediate portion of the wippen 4, an L-shaped jack 6 fixed pivotably at an angled portion thereof to the front end portion of the wippen 4, a hammer shank 7 supported pivotably at the front end portion thereof on a flange $f_2$ on a shank rail $R_2$, and a hammer 8 provided at the free end of the shank 7. When an operating portion of a key 3 is pressed downward, the wippen 4 is turned upward via a capstan screw 3*a* on the key 3 and a wippen heel 4*b*. In accordance with this pivotal movement of the wippen 4, the repetition lever 5 and jack 6 are moved up together to cause the upper end of the jack 6 to push up a knuckle 7*a*. While the repetition lever 5 and jack 6 are moved up, the front end of a lateral member of the jack 6 engages a regulating button 9, and the jack 6 is turned clockwise and disengaged at the upper end thereof from the knuckle 7*a*.

"Let off" or "set off" is the period of time during which the jack 6 has engaged the regulating button 9, but the jack 6 has not yet been disengaged from the knuckle 7*a*. A human pianist depressing a key will feel let off as a "bump," or a brief period of increased resistance in the key. The moment when the jack 6 engages the regulating button 9 is known as the "beginning of let off" or the "beginning of set off." The position of the hammer 8 at the beginning of let off will be known herein as the hammer let off position 8*a*.

Let off ends when the jack 6 disengages from the knuckle 7*a*. From this point on, the shank 7 and the hammer 8 are no longer under the control of the pianist. They are in free flight, subject only to the influences of gravity and friction.

A damper mechanism D is provided at the back of each action mechanism A, and consists of a damper lever 14 which is supported pivotably at the rear end portion thereof on a flange $f_3$ on a damper rail $R_3$ fixed to the front surface of the lower portion of a rear case 10 in the piano body, and which is superposed at the front end portion thereof on the rear end portion of the key 3, a damper wire 15 standing up from the front end portion of the lever 14 so as to pass through a damper guide holder 12 provided on the front end portion of a sound board 11, and further extend in the upward direction, and a damper head 16 fixed to the upper end of the damper wire 15 and contacting the string g from the upper side thereof. When the key is pressed, the lever 14 is turned upward. In accordance with the upward movement of the lever 14, the damper wire 15 is moved up to separate the damper head 16 temporarily from the string g, whereby a sound is produced by a string striking operation of the hammer 8. When the key is no longer depressed, the damper head 16 is brought into contact with the string g to stop the unnecessary sound. A damper guide rail 12 (which is divided into a plurality of parts correspondingly to the strings extending in the planes of different heights at lower and higher sound volume portions) is provided on the front end portion of the sound board 11 so as to extend in the widthwise direction of the piano body.

Figure 2:
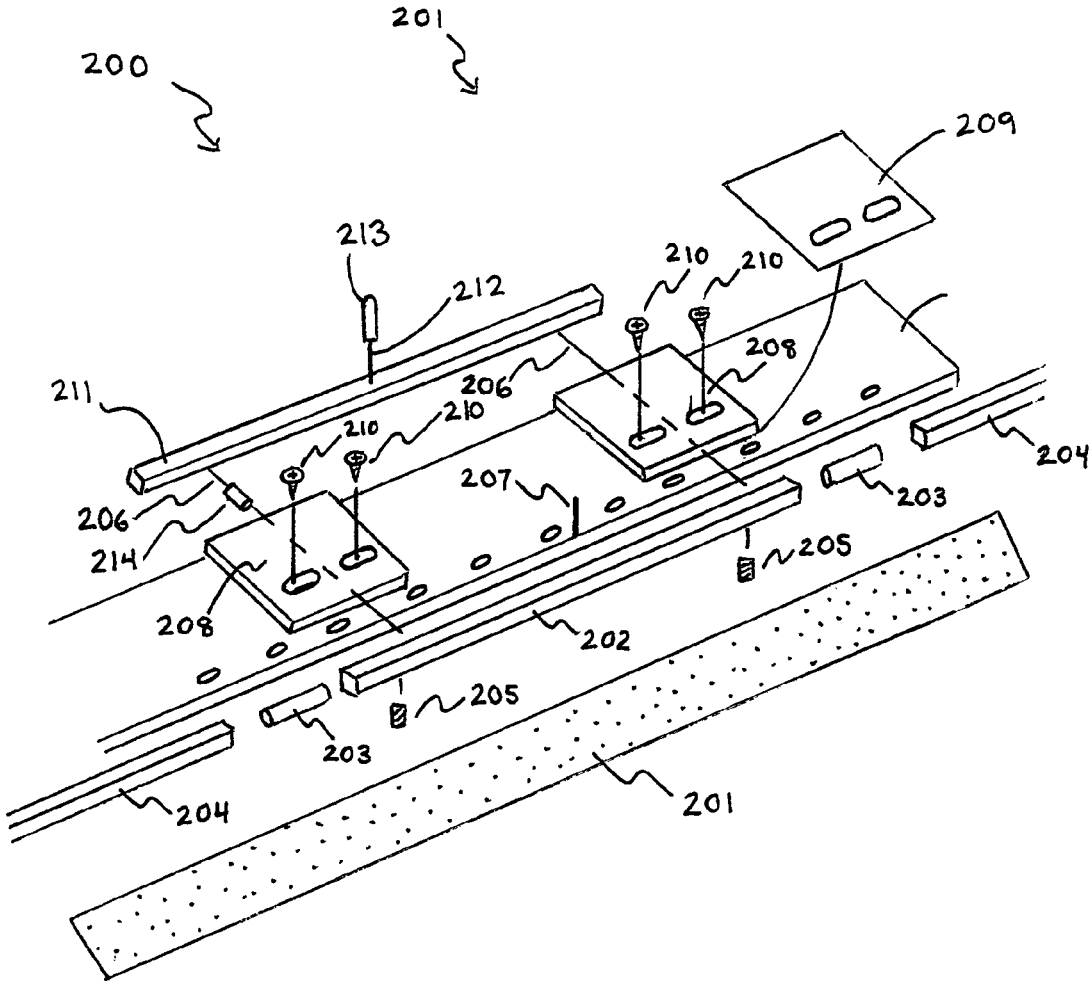
FIG. 2 is an exploded perspective view of a piano muffler mechanism, in accordance with an embodiment of the invention.

FIG. 2 is an exploded perspective view of a muffler section 200 of a piano muffler mechanism, in accordance with an embodiment of the invention. The piano muffler section 200 is designed to be mounted in a piano 201. A piano muffler mechanism may consist of one or more muffler sections 200.

In implementations of the invention, multiple muffler sections 200 may be installed in a piano. For example, three muffler sections 200 may be installed. Using multiple muffler sections 200 may confer several advantages, as will be discussed further with reference to FIG. 4. In other implementations, however, only one muffler section 200 may be used.

Each muffler section 200 may include a cushioning material 201. The cushioning material 201 may be made, for example, of woven or pressed felt, or of another suitable material. In embodiments of the invention, the cushioning material may be made of felt with a thickness in the range of 1/64 inch-1/2 inch.

The cushioning material 201 is designed to be installed between the hammer 8 and the string g of FIG. 1, such that the cushioning material 201 will soften the blow of the hammer 8. Thus, the cushioning material 201 may reduce or eliminate the percussive sound of the hammer striking the string g. In addition, because of the reduced impact of the hammer strike, the tonal sound created by the string g will have a reduced volume.

The muffler section 200 may include a front rail 202. The front rail 202 may be used to support the cushioning material 201. In one embodiment, the front rail 202 may be a square tube made of brass or another suitable material. In another embodiment, the front rail 202 may be a right angle bracket. Using a right angle bracket for the front rail 202 may allow additional clearance for the hammer 8, so that the hammer 8 does not strike the front rail 202 when the muffler is in an engaged position. In still another embodiment, square tubing is used for some muffler sections, while a right angle bracket is used for other muffler sections. For example, a right angle bracket may be used in the bass section of the piano, where the hammers are larger and additional clearance may be required. Other configurations are possible.

The muffler section 200 may also include one or more front rail couplers 203. In one implementation, the front rail couplers may be made of round brass tubing, and may have a diameter of 1/8 inch and a length of 1 inch. The front rail couplers 203 may be used to couple the front rail 202 to the front rail wing extensions 204.

The muffler section 200 may include one or more front rail wing extensions 204. The front rail wing extensions 204 may be used to alter the length of the muffler section 200 to provide a customized fit into a piano.

The muffler section 200 may also include one or more glide rods 206. The glide rods 206 may be secured to the front rail 202 by means of setscrews 205.

The muffler section 200 may also include a stop pin 207. In embodiments of the invention, the muffler may be moved between an engaged position, in which piano playing is muffled, and a disengaged position, during which piano playing is not muffled. The stop pin 207 may ensure that the muffler section 200 does not slide backward (away from the pianist) beyond the desired disengaged position, so that the muffler section 200 does not interfere with the damper wires 15.

Figure 3:
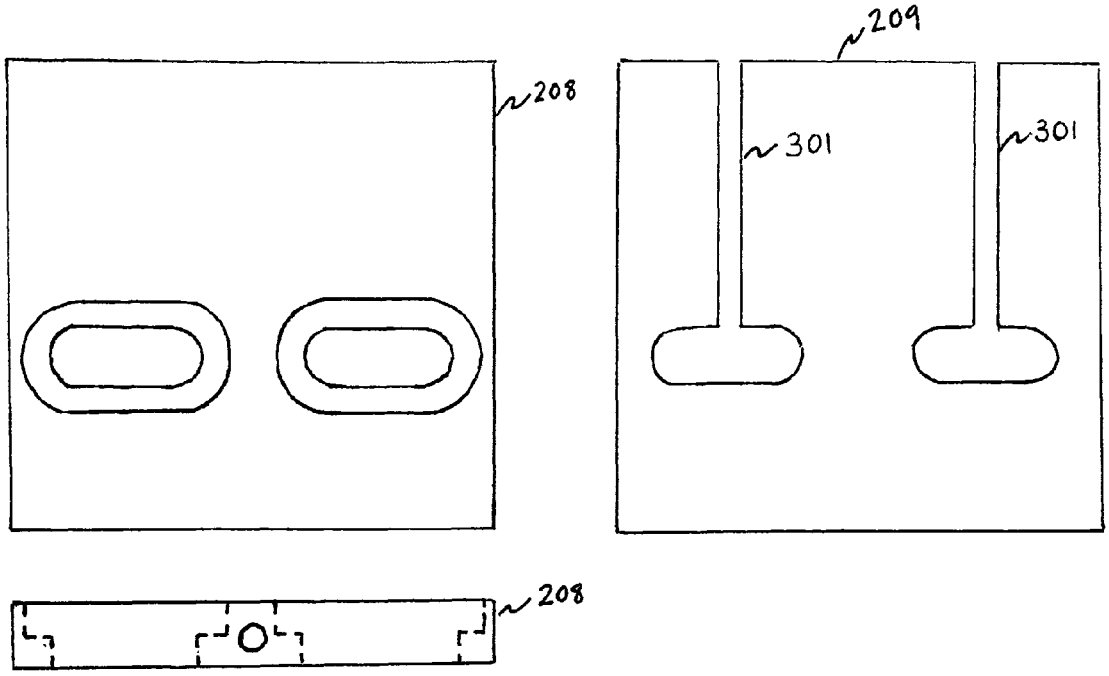
FIG. 3 is a plan view and side view of a shim, in conjunction with which embodiments of the invention may be practiced.

The muffler section 200 may also include one or more glide rod brackets 208. The glide rod brackets 208 may allow the muffler section 200 to be mounted onto the damper guide rail 12. The glide rod brackets 208 may be mounted onto the damper guide rail 12, for example, using one or more bracket screws 210. The bracket screws 210 may be, for example, #4 sheet metal screws with a length of ½ inch. The glide rod brackets 208 may be made, for example, of brass or another suitable material. As shown in FIG. 3, the glide rod brackets 208 may have through-holes to allow the glide rods 206 to slide longitudinally through the glide bar brackets 208.

The muffler section 200 may also include one or more shims 209. The shims 209 may be used, for example, to configure the muffler section 200 to the piano to ensure a precise fit. For example, the shims 209 may be used to ensure correct spacing between the cushioning material 201 and the string g (not shown in FIG. 2). The shims will be described in further detail with reference to FIGS. 3-4.

The muffler section 200 may also include a back rail 211, which may provide stability. The back rail 211 may be fixed to the glide rod brackets, for example, by soldering or another appropriate method. The back rail 211 may be made, for example, of square brass tubing. A pull pin 212 and a pull pin cap 213 may be mounted to the back rail 211. The pull pin 212 may be made, for example, of a brass rod with 3⁄32 inch diameter and 1 inch length. The pull pin cap 213 may be made, for example, of plastic. The pull pin 212 and pull pin cap 213 may allow the muffler section 200 to be manipulated to engage or disengage the muffler section 200. The pull pin 212 and pull pin cap 213 may also be used to manipulate the muffler section 200 during installation, repair, and the like.

The muffler section 200 may further include one or more glide rod stop sleeves 214, which may ensure that the cushioning member 201 is in correct position when the muffler mechanism is engaged. The glide rod stop sleeves may ensure that the muffler section 200 does not slide forward (toward the pianist) beyond the desired position. The glide rod stop sleeves 214 may also provide stability. The glide rod stop sleeves may be made, for example, of brass tubing having a diameter of ⅛ inch and a length of ½ inch.

In one embodiment of the invention, the muffler section(s) 200 are shipped as an after-market product, to be installed in fully assembled pianos. Some or all of the component parts may be cut down or otherwise adapted to fit into an existing piano. In another embodiment, some or all of the components of the muffler section 200 may be coupled together before shipping to form pre-assembled parts.

As shown in FIGS. 2-3, the invention may include one or more shims 209. The shims 209 may be configured to elevate the glide rod brackets 208. In one implementation, the shims 209 may be configured to fit beneath the glide rod brackets 208, to raise, lower, or tilt the muffler section 200 relative to the damper guide rail 12. By raising, lowering, or tilting the muffler section 200, desired spacing between the muffler section 200 and the strings g may be achieved.

In one implementation of the invention, the hammer 8 may strike the cushioning member 201 during let off. As discussed above, the pianist typically feels a "bump" or period of increased resistance in the key during let off. This increased resistance may mask the feeling of the hammer 8 striking the cushioning member 201. Thus, if the hammer 8 strikes the cushioning member 201 during let off, there will not be a noticeable difference in the feel of the key.

The hammer 8 may also strike the cushioning member 201 after let off, when the hammer is in free flight. Because the hammer 8 is not under the control of the pianist during the period of free flight, the pianist will not feel the presence of the cushioning member 201.

In one implementation of the invention, the muffler section 200 may be positioned such that the cushioning member 201 is as close to the string g as possible without interfering with the vibration of the string g. In this implementation, the hammer 8 may strike the cushioning member 201 during let off for some keys, and during free flight for other keys. For example, the hammer 8 may strike the cushioning member during let off for the lower pitched keys, and during free flight for the higher pitched keys.

In addition, for some keys, the hammer 8 may strike the cushioning member 201 just before let off begins. Because pianos have varying designs, it may not always be practical or possible to install the muffler section 200 such that the hammer 8 strikes the cushioning member 201 during let off or free flight for each key in the piano. The muffler section may thus be positioned such that the hammer 8 strikes the cushioning member 201 a fraction of a second before let off begins for some or all of the keys in the piano. In this case, the feeling of the hammer 8 striking the cushioning member 201 will nonetheless be masked by the increased resistance or "bump" of let off, which immediately follows.

In implementations of the invention, in order to ensure that the hammer 8 strikes the cushioning member 201 during let off, during free flight, or just before let off, the muffler section 200 should be installed such that the cushioning member 201 is placed substantially between the hammer let-off position **8*a* and the string g. In some implementations, the cushioning member maybe placed such that the hammer 8 strikes the cushioning member 201 before let off begins. However, in this case, the cushioning member should optimally be placed not more than ⅛ inch from the hammer let-off position 8*a***.

When the string g is struck by the hammer 8, it vibrates to create a tonal sound. The string g may vibrate with an amplitude a, within a vibration space V. If the cushioning member 201 were positioned within the vibration space V, it would interfere with the vibrations of the string g. Thus, in implementations of the invention, the cushioning member 201 is not positioned within the vibration space V. The cushioning member 201 may be positioned in the space S between the hammer let-off position **8*a*** and the vibration space V.

In many piano models, let off begins earlier for lower-pitched keys and later for higher-pitched keys. Thus, the distance between the string g and the hammer let-off position **8*a* may vary for each string g. The hammer let-off position 8*a*** may be further from the string g for lower pitched keys, and closer to the string g for higher-pitched keys.

Furthermore, each string g may have a distinct length and mass, which cause it to create the desired tonal sound. Because of the differences in length and mass, each string g may vibrate with a different vibration amplitude a.

Because each action mechanism A may have a different hammer let-off position **8*a*** and a different vibration amplitude a, the size and position of the space S may vary for each action mechanism. In many pianos, as the keys go from a lower pitch to a higher pitch, the space S decreases and is positioned closer to the string g.

In addition, the damper guide rail 12 may be sectioned, and each section may be at a different height. Because the muffler sections 200 may be mounted to the damper guide rail 12, this makes installation of the muffler sections 200 more difficult.

The shims 209 shown in FIGS. 2-3 may be used to configure one or more muffler sections 200 to a particular piano. In one implementation, multiple shims 209 may be provided. For example, a plurality of shims with a variety of thicknesses may be provided. In one implementation, shims with thicknesses of 1/32 inch, 1/16 inch, and 1/8 inch are provided. The shims may be made, for example, of delrin plastic, another type of plastic, metal, wood, or another appropriate material.

The shims 209 may be placed under one or more of the glide rod brackets 208 to ensure proper positioning of the cushioning member 201. For example, the shims 209 may be used to ensure that the cushioning member 201 is placed in the space S. This may ensure that the cushioning member 201 does not interfere with the vibration of the string g, and that the hammer 8 strikes the cushioning member only after let off has begun. Use of the shims will be discussed further in relation to FIG. 4.

In one implementation, the shims may have slots 301 or other cut-out portions. The slots 301 may allow the shims 209 to be more easily positioned beneath the glide rod brackets 208. For example, the slots 301 may allow the shims 209 to be positioned while the bracket screws 210 are in place. During installation, various shims 209 may be added, removed, or substituted as the installer works to achieve a custom fit to the piano. By sliding the shims 209 into place such that the bracket screws 210 are within the slot 301, an installer may position the shims while the bracket screws 210 are in place.

Figure 4:
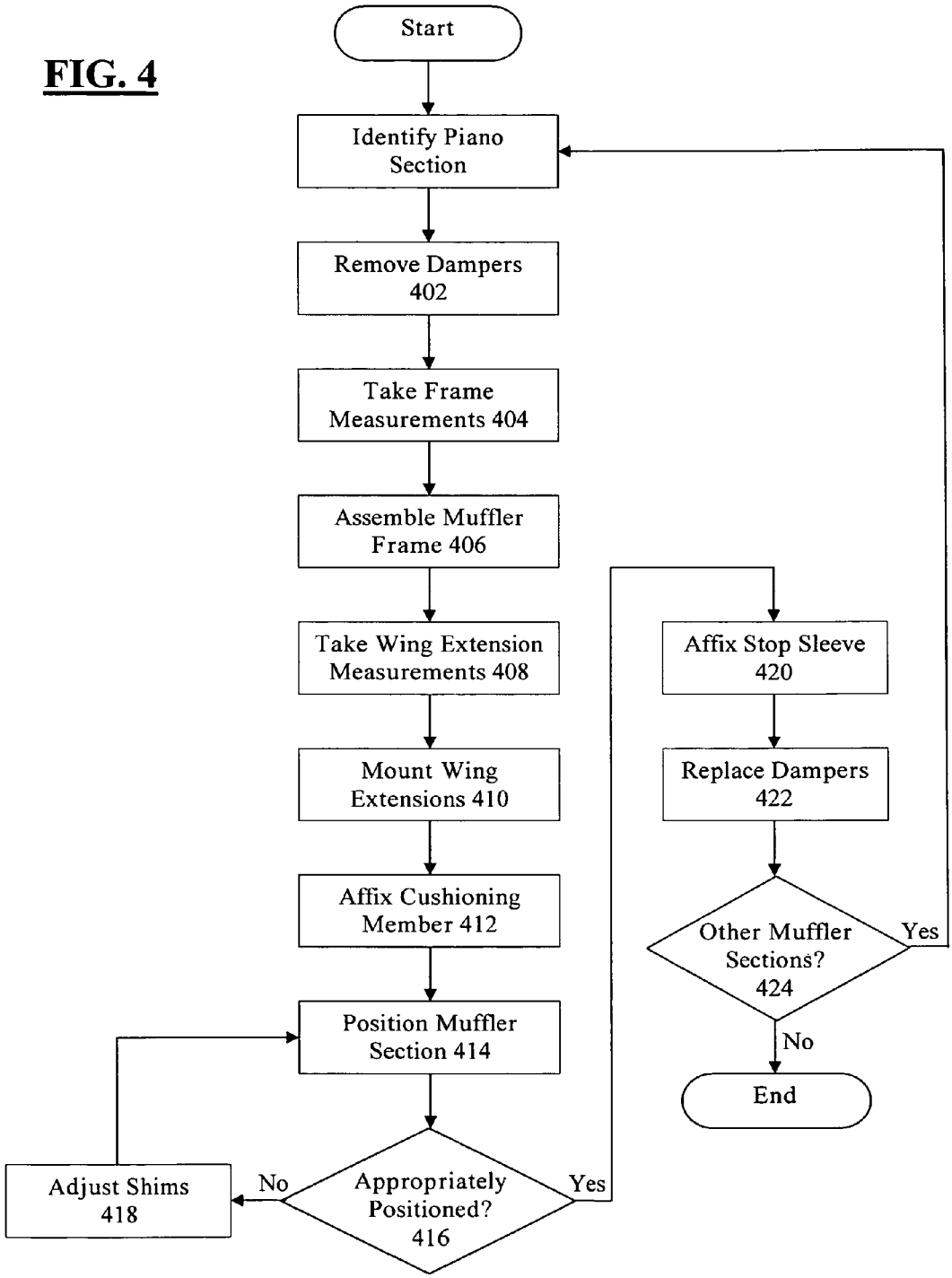
FIG. 4 is a flow chart illustrating a method for installing a piano muffler mechanism, in accordance with an embodiment of the invention.

FIG. 4 is a flow chart depicting a method for installing a piano muffler. The method may begin in step 400, wherein a piano section is identified. The piano section identified is the group of action mechanisms A to be muffled by a piano muffler section. In one implementation, a piano may be divided into three piano sections, known as bass, tenor, and treble.

In step 402, one or more dampers are removed. The dampers may be removed to allow access to the damper guide rail 12. In one implementation of the invention, some of the dampers in the identified piano section are removed, while other dampers in the identified piano section are left in place. For example, as will be discussed further with regards to step 408, dampers may be removed as necessary to allow access to the damper guide rail 12, while other dampers are left in place.

In step 404, measurements are taken for the muffler frame. The measurements taken may include measurements for the front rail 202, back rail 211, and glide rods 206. In one implementation, the length of the front rail 202 and back rail 211 may be based on the length of the identified piano section, or based on the length between certain strings g. For example, in one implementation, the length of the front rail and the back rail is based on a span of 8 keys. In this implementation, an installer may measure the distance between the center string g for the lowermost key in the span and the center string g for the uppermost key in the span. The length of the front rail 202 and the back rail 211 may be this distance plus 1 inch. The length of the glide rods 206 may be based on the distance between the damper guide rail 12 and the strut (not shown), or the distance between the damper guide rail 12 and the back edge of the damper heads 16. For example, the length of the glide rods 206 may be the distance between the damper guide rail 12 and the strut plus 1.5 inches, or may be the distance between the damper guide rail 12 and the back edge of the damper heads 16 plus 1.5 inches. These measurements may ensure that the glide rods 206 do not interfere with the damper wires 15, and that the mechanism may be properly engaged and disengaged. The exact measurements and configuration are not limited to the embodiments described herein. Other measurements and configurations may be used.

In step 406, a muffler frame may be assembled. The muffler frame may be assembled, for example, by cutting the front rail 202, the back rail 211, and the glide rods 206 to the appropriate size; and by soldering the back rail 211 to the glide rods 206, sliding the glide rod stop sleeves 214 and the glide rod brackets 208 onto the glide rods 206, and screwing the front rail 202 to the glide rods 206 using setscrews 205.

In one implementation, the angles between the glide rods 206 and the front and back rails 202, 211 may be determined by the configuration of the piano. For example, in some pianos, the strings g may not be perpendicular to the front rail 12, but may be set at an angle. In this case, the configuration of the strings and the front rail may be measured, traced, or otherwise noted. The glide rods 206 may be mounted to the front and back rails 202, 211 at substantially the same angle as the angle between the strings g and the front rail 12. This may ensure that the glide rods 206 do not interfere with the strings g or the damper wires 15.

The muffler frame is not limited to the configuration described and shown in the Figures. Multiple designs for the muffler frame are possible, provided the muffler frame may be mounted into a piano and provides a stable surface on which to mount a cushioning member 201. In one implementation of the invention, the muffler frame may be pre-assembled, for example, by welding. In another implementation, the muffler frame may be fabricated in one piece.

In step 408, wing extension measurements may be taken. In order to take wing extension measurements, the muffler frame may be positioned in the piano. In one implementation, the muffler frame is positioned on the damper guide rail. In implementations of the invention, the muffler frame is mounted using glide rod brackets 208, which have a relatively small footprint. This allows the muffler frame to be positioned without removing all the dampers in the piano section. For example, in step 404, eight dampers may be removed to allow access to the damper guide rail 12. In step 406, the muffler frame may be positioned so that the glide rod brackets 208 rest upon the damper guide rail 12, and the glide rods 206 are spaced between the damper wires 15. The muffler frame may be fully or partially affixed to the damper guide rail 12 using bracket screws 210.

Once the muffler frame is positioned in the piano, measurements for the front rail wing extensions 204 may be taken. The front rail wing extensions are designed to extend the front rail 202, such that the length of the length of the muffler section 200 is substantially the same as the length of the piano section. The front rail wing extensions 204 should in one embodiment be long enough that they extend past all strings g in the identified piano section, but should not be so long that they interfere with mounting screws on the damper guide rail 12 or with other structural elements of the piano. In order to take measurements 408 for the front rail wing extension 204, the distances from the ends of the front rail to a position beyond the furthermost strings g in the piano section may be measured.

In some cases, however, front rail wing extensions 204 are not used. For example, the front rail 202 may be configured to be substantially the same as the length of the piano section, and thus the front rail wing extensions are not needed.

In step 410, front rail wing extensions 204 may be mounted. In order to mount the front rail wing extensions 204, the frame may be removed from the piano section. One or more front rail wing extensions 204 may then be mounted to the front rail 202, as needed. In one implementation, an assortment of front rail wing extensions 204 of varying lengths may be provided, and one or more front rail wing extensions of appropriate lengths may be selected from the assortment. In another implementation, the front rail wing extensions may be cut down to the appropriate size. The front rail wing extensions 204 may be mounted to the front rail 202, for example, by soldering or another appropriate method. In some implementations, the front rail wing extensions 204 are not used.

Also in step 410, the pull pin 212 may optionally be soldered to the back rail, and the pull pin cap 213 may optionally be placed on the pull pin 212. The pull pin 212 and the pull pin cap 213 may be used to engage and disengage the muffler section 200. For example, a piano owner may grasp the pull pin cap 213 and slide the muffler section 200 backwards (away from the keybed), to disengage the muffler section 200 and allow for a piano performance of normal volume. When lower volume piano performance is desired, the piano owner may grasp the pull pin cap 213 and slide the muffler section 200 forward (toward the keybed) to engage the muffler section 200.

In step 412, the cushioning member 201 may be affixed to the muffler section 200. Measurements for the cushioning member 201 may first be taken. The length of the cushioning member 201 may be substantially equal to the length of the front rail 202, plus the lengths of any front rail wing extensions 204. The cushioning member 201 may be wider than the front rail 202, so the cushioning member extends past the front edge of the front rail 202. The cushioning member 201 should be wide enough that, when the muffler section 200 is engaged, the front portion of the cushioning member is located between the hammer 8 and the string g, such that the hammer 8 will strike the cushioning member 201 but will not come into contact with the front rail 202. The cushioning member should be narrow enough that, when the muffler section 200 is disengaged, the cushioning member will not interfere with the hammer 8. Once measurements are taken, the cushioning member may be cut to the appropriate size. The cushioning member may be affixed to the front rail 202, and to any front rail wing extensions 204, by gluing or another appropriate method.

In step 414, the muffler section 200 is positioned in the piano. In one implementation, the muffler section 200 is positioned on the damper guide rail, similarly to the positioning described with respect to step 408. In some implementations, the muffler section 200 may be mounted to the damper guide rail using the bracket screws 210. The bracket screws 210 may be fully tightened or may be only partially tightened. In other implementations, the muffler section 200 is positioned but not mounted.

In step 416, it is determined whether the muffler section 200 is appropriately positioned. In one implementation, the muffler section 200 is appropriately positioned if the cushioning member 201 falls within the space S for each action mechanism in the piano section. In one implementation, the muffler section 200 is placed such that the cushioning member 201 is as close as possible to the strings g without interfering with their vibration. In this implementation, a user may depress each key in turn to determine whether the cushioning member 201 interferes with the vibration of the string g. If the cushioning member interferes with the vibration of the string g, the desired tonal sound will be quickly cut off even when the key remains depressed. The user may also determine whether the cushioning member is placed between the hammer let-off position 8*a* and the string g. The user may do this by depressing each key in turn. If the hammer 8 strikes the cushioning member 201 before the user feels the beginning of let off, or before the user visually observes the beginning of let off, the cushioning member is not between the hammer let-off position 8*a* and the string g.

If it is determined that the cushioning member 201 is not appropriately positioned, in step 418, the shims 209 may be adjusted. In particular, the number or selection of shims may be adjusted. For example, if the cushioning member 201 interferes with the vibration of one or more strings, fewer shims may be used, or shims of lesser thickness may be used. If the cushioning member 201 is not placed between the hammer let-off position 8*a* and the string g, more shims 209 may be used, or shims 209 of greater thickness may be used. In addition, shims 209 of different thicknesses may also be used to tilt the cushioning member 201 relative to the damper guide rail, so that the cushioning member 201 is appropriately positioned. In one implementation, the shims 209 may be adjusted such that the cushioning member 201 is as close as possible to the strings g, without interfering with the vibration of the strings g. After the strings are adjusted, the method may return to step 414, and the muffler section may be positioned. Alternatively, the muffler section may already be in position. For example, if the shims 209 contain slots 301, the shims may be inserted while the muffler section 200 is mounted to the damper guide rail 12. In this case, there is no need to position the muffler section 414, and the method may return to step 416.

If it is determined that the cushioning member 201 is appropriately positioned, one or more stop sleeves may be affixed 420. The glide rod stop sleeves 214 may ensure that the muffler section 200 does not slide forward (toward the pianist) beyond the desired position. The glide rod stop sleeves 214 may also provide stability.

In step 422, the dampers may be replaced. At this point, the installation of the muffler section is complete. In step 424, it is determined whether there are other muffler sections to be installed.

In one embodiment, a plurality of muffler sections 200 are installed into a piano. Using multiple portions 200 may simplify the installation process, because each muffler section 200 may be smaller and more easily maneuverable. In addition, the damper guide rail 12 may consist of multiple separate sections, or a plurality of damper guide rails 12 may be used. Using multiple muffler sections 200 may further ease installation because one or more muffler sections may be used for each damper guide rail 12 or section of a damper guide rail 12.

In addition, if multiple portions 200 are used, each of the portions 200 may include a cushioning member 201 of a different thickness. For example, if three muffler sections are used, in the portion 200 installed in the bass range of the piano, the cushioning member 201 may have a thickness of 0.072 inches. In the tenor range of the piano, the cushioning member 201 may have a thickness of 0.052 inches. In the treble range of the piano, the cushioning member 201 may have a thickness of 0.032 inches. Using cushioning members of different thicknesses may allow for a uniform dampening effect.

If there are other muffler sections to be installed, the method returns to step 400, and another muffler section is installed. If there are no other muffler sections to be installed, the method ends.

While preferred embodiments of the invention have been described, the invention is not intended to be limited to the specific configurations described herein. For example, while the invention has been described in terms of a retrofit kit that may be installed into pianos with different configurations, embodiments of the invention may include mechanisms designed to fit one particular piano model. In such embodiments, the shims may be integrally formed with the brackets. The brackets may have differing thicknesses, depending on the configuration of the piano model. Alternatively, one or more wedge-shaped brackets may be provided. In other embodiments, components of the muffler section may be pre-formed as a single piece or may be fixed together.

Furthermore, while the invention has been described as positioning the cushioning member between the hammer let-off position and the string, embodiments of the invention may position the cushioning member at the hammer let-off position or just before the hammer let-off position. Because a human pianist feels increased resistance at the moment let off begins, the further resistance that the pianist may feel when the hammer strikes the cushioning member may be masked by the sensation of let off.

In addition, while the invention has been described with reference to a grand piano, embodiments of the invention may be used in upright pianos.

Furthermore, while the invention has been described in terms of particular systems and methods, the invention is not limited to the particular implementations described herein. In particular, method steps may occur in a different order from the order described herein, and some steps may be omitted. Furthermore, the system is not limited to the particular configuration described herein. Alternate configurations are possible.

What is claimed is:

1. A muffler section configured and dimensioned to be mounted in an acoustic piano and to muffle one or more adjacent action mechanisms of the piano, each action mechanism comprising at least one string and a hammer having a hammer let-off position, the muffler section comprising:

a cushioning member; and a mounting member configured and dimensioned to mount the cushioning member within the piano such that the cushioning member lies substantially between the hammer let-off position and the string of at least one of the adjacent action mechanisms, the cushioning member being tilted laterally with respect to a damper guide rail at an angle in the range of approximately 0.5 to 40 degrees.

2. The muffler section of claim 1, wherein the mounting member is configured and dimensioned to mount the cushioning member within the piano such that the cushioning member lies substantially between the hammer let-off position and the string of each of the adjacent action mechanisms.

3. The muffler section of claim 1, wherein the cushioning member and the mounting member are configured and dimensioned to be assembled to one another by a user prior to or during installation.

4. The muffler section of claim 1, wherein the cushioning member and the mounting member are integral to one another.

5. The muffler section of claim 1, wherein the mounting member comprises at least one mounting bracket configured and dimensioned to be attached to a damper guide rail of the piano, wherein a length of the mounting bracket is substantially less than a length of the damper guide rail.

6. The muffler section of claim 5, wherein the length of the mounting bracket is less than about 70% of the length of the damper guide rail.

7. The muffler section of claim 1, wherein the mounting member comprises at least one rail and at least one mounting bracket configured and dimensioned to be assembled to one another by a user prior to or during installation.

8. The muffler section of claim 1, wherein the mounting member comprises at least one rail and at least one mounting bracket integral to the rail.

9. The muffler section of claim 1, further comprising one or more shims.

10. The muffler section of claim 9, wherein the shims are configured and dimensioned to adjust the position of the cushioning member within the piano such that the cushioning member is tilted laterally with respect to a damper guide rail of the piano.

11. The muffler section of claim 1, wherein the muffler section is configured and dimensioned to be moved between an engaged position in which the cushioning member is in a trajectory of the hammer, and a disengaged position in which the cushioning member is not in the trajectory of the hammer.

12. A muffler section configured and dimensioned to be mounted in an acoustic piano, the piano comprising a damper guide rail, the muffler section comprising:

a cushioning member; and at least one mounting bracket configured and dimensioned to be attached to the damper guide rail to mount the cushioning member within the piano, wherein a length of the mounting bracket is substantially less than a length of the damper guide rail.

13. The muffler section of claim 12, further comprising one or more shims.

14. The muffler section of claim 13, wherein the shims are configured and dimensioned to adjust the position of the cushioning member within the piano such that the cushioning member is tilted laterally with respect to the damper guide rail.

15. The muffler section of claim 12, wherein the muffler section is configured and dimensioned to be moved between an engaged position in which the cushioning member is in a trajectory of the hammer, and a disengaged position in which the cushioning member is not in the trajectory of the hammer.

16. A method of installing a cushioning member configured and dimensioned to muffle one or more adjacent action mechanisms in an acoustic piano, each action mechanism comprising a damper, at least one string, and a hammer having a hammer let-off position, the method comprising:

mounting the cushioning member within the piano such that the cushioning member lies substantially between the hammer let-off position and the string of at least one of the adjacent action mechanisms, the mounting step including:

positioning a muffler section in the piano, the muffler section comprising the cushioning member;

determining whether the cushioning member lies substantially between the hammer let-off position and the string; and if the cushioning member does not lie substantially between the hammer let-off position and the string, adjusting a selection of shims to position the muffler section relative to a damper guide rail of the piano.

17. The method of claim 16, wherein adjusting the selection of shims comprises at least one of adding or removing one or more shims to the selection of shims, to raise, lower, or tilt the muffler section relative to the damper guide rail.

18. The method of claim 16, further comprising:

removing at least a first damper to expose a length of a damper guide rail of the piano while leaving at least a second damper in place; and mounting the muffler section within the piano by securing one or ore mounting brackets of the muffler section to the exposed length of the damper guide rail.

19. A piano muffler kit configured and dimensioned to be mounted into an acoustic piano, the piano muffler kit comprising:

one or more rail portions, configured and dimensioned to be adapted as a front rail and a back rail;

one or ore wing extension portions, configured and dimensioned to be adapted as one or more wing extensions;

one or more rod portions, configured and dimensioned to be adapted as one or more glide rails and to be fixed to the front rail and the back rail;

one or more brackets configured and dimensioned to be mounted to a damper guide rail, the brackets being configurable to allow the glide rails to slide through the brackets;

a plurality of shims; and a cushioning member, configured and dimensioned to be mounted to the front rail and used to muffle a sound of the piano.

20. The piano muffler kit of claim 19, wherein the brackets are configured and dimensioned to be attached to the damper guide rail to mount the cushioning member within the piano, wherein a length of the mounting bracket is substantially less than a length of the damper guide rail.

21. The piano muffler kit of claim 19, wherein one or more of the plurality of shims is configured and dimensioned to mount the cushioning member within the piano such that the cushioning member lies substantially between a hammer let-off position and a string of an adjacent action mechanism of the piano.

* * * * *